US006244148B1

(12) United States Patent
Vees

(10) Patent No.: US 6,244,148 B1
(45) Date of Patent: Jun. 12, 2001

(54) CUTTING DEVICE

(75) Inventor: Hermann Vees, Jagstzell (DE)

(73) Assignee: Aichele Werkzeuge GmbH, Crailsheim (DE)

( * ) Notice: Subject to any disclaimer, the term of this patent is extended or adjusted under 35 U.S.C. 154(b) by 0 days.

(21) Appl. No.: 09/362,824

(22) Filed: Jul. 28, 1999

(30) Foreign Application Priority Data

Jul. 29, 1998 (DE) ..... 198 34 104

(51) Int. Cl.[7] ..... B26D 1/40

(52) U.S. Cl. ..... 83/348; 83/344; 83/506; 83/347

(58) Field of Search ..... 83/344, 506, 348, 83/347, 346, 659, 343

(56) References Cited

U.S. PATENT DOCUMENTS

| | | | | |
|---|---|---|---|---|
| 3,106,121 | * | 10/1963 | Novick | 83/346 |
| 3,257,885 | * | 6/1966 | Hornung | 83/348 |
| 3,274,874 | * | 9/1966 | Treiber et al. | 83/348 |
| 4,341,525 | * | 7/1982 | Wittkopf | 83/344 |
| 4,359,919 | * | 11/1982 | Fuchs et al. | 83/348 |
| 4,455,903 | * | 6/1984 | Kesten | 83/346 |
| 4,759,247 | * | 7/1988 | Bell et al. | 83/346 |
| 4,770,078 | * | 9/1988 | Gautier | 83/344 |
| 5,174,185 | | 12/1992 | Aichele . | |
| 5,311,800 | * | 5/1994 | Focke et al. | 83/344 |
| 5,388,490 | * | 2/1995 | Buck | 83/344 |
| 5,467,678 | * | 11/1995 | Stollenwerk | 83/344 |

FOREIGN PATENT DOCUMENTS

| | | |
|---|---|---|
| 1 436 912 | 3/1969 | (DE) . |
| 39 24 053 | 1/1991 | (DE) . |

* cited by examiner

*Primary Examiner*—Kenneth E. Peterson
*Assistant Examiner*—Stephen Choi
(74) *Attorney, Agent, or Firm*—Barry R. Lipsitz

(57) ABSTRACT

To improve a cutting device comprising a machine frame, a rotatably mounted anvil drum with an anvil surface, a rotatably mounted cutting tool with a cutter cooperating with the anvil surface in such a way that in successive rotary positions, respectively successive cutter sections stand in an operative position with successive anvil surface sections in order to cut a material passing through between the cutting tool and the anvil drum, such that the cutting tool has as long a service life as possible, it is proposed that the cutting tool and the anvil drum be pretensioned, that the cutting tool be supported by at least one supporting ring via successive supporting ring sections on successive supporting surface sections of the anvil drum, that the respectively operative supporting ring section act on the respectively operative supporting surface section with a bearing force corresponding approximately to the difference between pretensioning force and cutting force, and that the supporting ring be of such construction in the respectively operative supporting ring section relative to the corresponding cutter section that the supporting ring holds the cutter section standing in the operative position at a defined spacing from the corresponding operative anvil surface section with the varying bearing force respectively resulting from approximately the difference between pretensioning force and cutting force.

13 Claims, 6 Drawing Sheets

2
62
10
64
60
12
22
102
106
16
18
82
80
84
90
74
70
72
20
76
24
2

80
100
102
A
96
84
92c
92b
104
92
92a
106
92a
A
104s
106s
S
108s
110s
V
108
110
76s
92s
74
70
76

92a
104
100'
80
R3
84
Δ
R2

92c
104
100'
80
R1
84

CUTTING DEVICE

The present disclosure relates to the subject matter disclosed in German patent application No. 198 34 104.0 of Jul. 29, 1998, the entire specification of which is incorporated herein by reference.

BACKGROUND OF THE INVENTION

The invention relates to a cutting device comprising a machine frame, an anvil drum mounted on the machine frame for rotation about an axis of rotation and having an anvil surface, a cutting tool mounted on the machine frame for rotation about an axis of rotation and having a cutter cooperating with the anvil surface in such a way that in successive rotary positions, respectively successive cutter sections stand in an operative position with successive anvil surface sections in order to cut a material passing through between cutting tool and anvil drum, the cutter being of such construction that different cutting forces occur when different cutter sections cooperate with corresponding anvil surface sections.

Such cutting devices are known from the prior art. The standard procedure with these is that the cutting tool is advanced towards the anvil drum to such an extent that even when the forces required for the cutting are at a maximum an adequate cutting action is still achieved.

However, this solution has the disadvantage that the cutters undergo very great wear in those areas in which lower cutting forces occur, and, in all, the cutting tool has only a relatively short service life.

The object underlying the invention is, therefore, to so improve a cutting device of the generic kind that the cutting tool has as long a service life as possible.

SUMMARY OF THE INVENTION

This object is accomplished with a cutting device of the kind described at the outset, in accordance with the invention, in that the cutting tool and the anvil drum are pretensioned in a direction towards each other with a pretensioning force, in that by means of at least one supporting ring arranged in a rotationally fixed manner relative to the cutting tool, the cutting tool is supported via successive supporting ring sections on successive supporting surface sections arranged in a rotationally fixed manner relative to the anvil drum, and the respectively operative supporting ring section acts on the respectively operative supporting surface section with a bearing force corresponding approximately to the difference between pretensioning force and cutting force, and in that the supporting ring is of such construction in the respectively operative supporting ring section applying the bearing force relative to the operative cutter section corresponding to this supporting ring section that the supporting ring holds the cutter section standing in the operative position at a defined spacing from the corresponding operative anvil surface section with the varying bearing force respectively resulting from approximately the difference between pretensioning force and cutting force.

The gist of the inventive solution is thus to be seen in the fact that the supporting effect of the supporting ring with a bearing force varying inversely to the varying cutting force is to be so adapted to the radial extent of the cutter sections with respect to the axis of rotation that in spite of the varying bearing force, the supporting ring holds the operative cutter sections essentially in a defined spacing range from the corresponding anvil surface sections, the spacing range being selected such that an adequate cutting action still always occurs. This is preferably a spacing range which is in the order of magnitude of less than several hundred micrometers, preferably less than one hundred micrometers.

Here it is to be assumed that the supporting ring, even if it is made of steel, will owing to the bearing force undergo deformation in the radial direction, i.e., that the radial extent of the supporting ring in relation to the axis of rotation will decrease, and the varying bearing force will result in the decrease in the radial extent of the supporting ring not being constant, but likewise varying with the varying bearing force.

These changes in the supporting ring caused by the varying bearing force are, in accordance with the invention, to be brought into line with the cutter.

If, for example, one assumes that the cutter with its cutter edges has an essentially constant radial extent with respect to the axis of rotation, there are several compensation possibilities with an appropriately designed supporting ring, and these possibilities are also usable with cutter edges which do not have an essentially constant radial extent.

One possibility is to impart a varying elasticity to the respectively successive supporting ring sections.

Such a varying elasticity could, for example, be realized by the material elasticity of the supporting ring being of directly varying design, for example, due to changes in material or structure, which can, for example, be realized by diffusing elements into the structure of the supporting ring.

Another possibility consists in imparting to the supporting ring a variable elasticity due to variation of shape. Such a variation in shape makes provision for the supporting ring to be made from material with homogeneous elasticity properties, but for the elasticity of the supporting ring to also be variable by variation of the shape of the supporting ring. For example, it is possible to achieve such a shape elasticity by the supporting ring having a variation in the cross-sectional area with respect to its cross-sectional areas extending perpendicularly to the azimuthal direction.

It is, for example, possible to produce such a variation of the cross-sectional area by providing a supporting ring with a constant cross section and making suitable recesses therein.

A particularly simple possibility of achieving such a cross-sectional variation is for the supporting ring to have a varying shape in a direction transverse to the radial direction and transverse to the azimuthal direction. Such a variation in shape can, for example, be realized by making recesses extending in this direction in the supporting ring, which is otherwise of constant cross section.

Such recesses can be expediently made as, for example, recesses starting from an outer edge and extending transversely to the azimuthal direction.

A further alternative solution enabling, in particular, a direct compensation of the deformation of the supporting ring in the radial direction which varies in accordance with the varying bearing force makes provision for the supporting ring to have a varying radial extent with respect to the axis of rotation. It is thus possible to deviate from the cylindrical surface, for example, due to a flattening or a recess to that extent to which the radial deformation of the supporting ring changes with varying bearing force. For example, the flattening or recess is of such dimensions in the radial direction that this change in the radial direction just compensates the change by which the supporting ring is deformed to a lesser extent when the bearing force changes from the maximum value towards the minimum value.

A further alternative of the inventive solution makes provision for the supporting ring to maintain a homogeneous material elasticity and an unchanged shape, and for the decrease in the deformation of the supporting ring during the transition from maximum bearing force to minimum bearing force to be taken into account by the cutter sections operative at minimum bearing force having a larger extent in the radial direction than the cutter sections with which the bearing force is maximum and the cutting force minimum.

Very different solutions are conceivable for the arrangement and construction of the supporting ring. For example, it is conceivable to provide the supporting ring as a separate ring which sits alongside the cutting tool, but the precision of the supporting action by the supporting ring relative to the cutting tool is then problematic. For this reason, provision is preferably made for the supporting ring to be seated on the cutting tool and for the supporting ring on account of a joint machining together with the cutting tool to preferably have the same truth of running as the cutting tool.

An advantageous possibility of fixing the supporting ring on the cutting tool consists in shrinking the supporting ring onto the cutting tool and optionally fixing it additionally in a positively fitting manner.

An alternative solution makes provision for the supporting ring to be integrally joined to the cutting tool and to thus be manufacturable jointly with the cutting tool as an integral part.

Very different possibilities are likewise conceivable for the design of the supporting surfaces on which the supporting ring rests. Purely theoretically, it is conceivable to arrange the supporting surfaces on a carrier ring alongside the anvil drum. However, this would likewise have disadvantages with respect to the precision.

For this reason, it is particularly advantageous for the supporting surfaces to be arranged directly on the anvil drum so that a joint centered machining of the supporting surfaces and the anvil surfaces is possible.

The supporting surfaces are manufacturable in a particularly simple way when they form a partial area of the anvil surfaces, as only one surface then has to be produced with the desired precision.

Further features and advantages of the invention are the subject matter of the following description and the drawings of several embodiments.

DETAILED DESCRIPTION OF THE INVENTION

Figure 1:
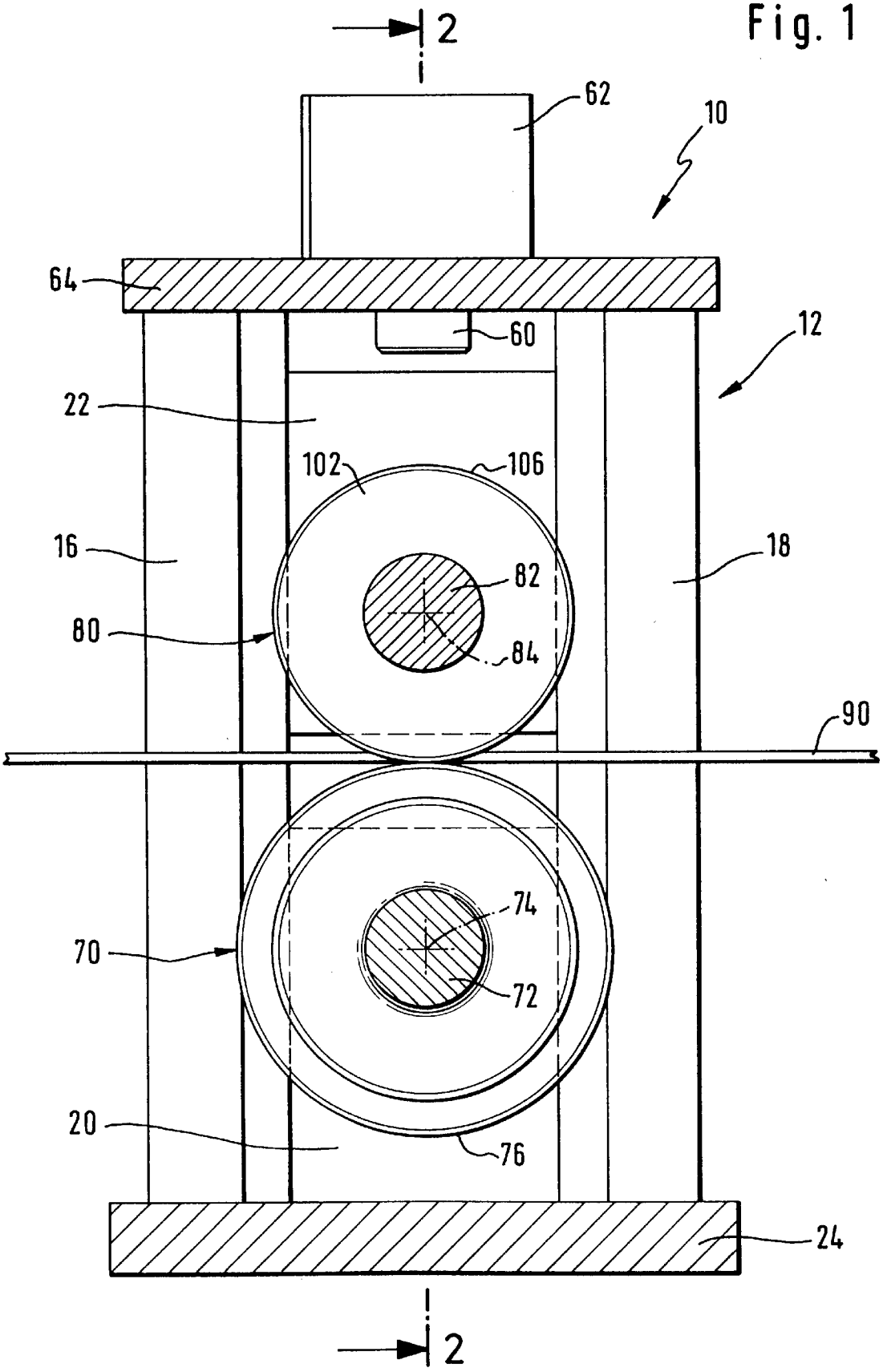
FIG. 1 a vertical section through an inventive cutting device taken along line 1—1 in FIG. 2.
Figure 2:
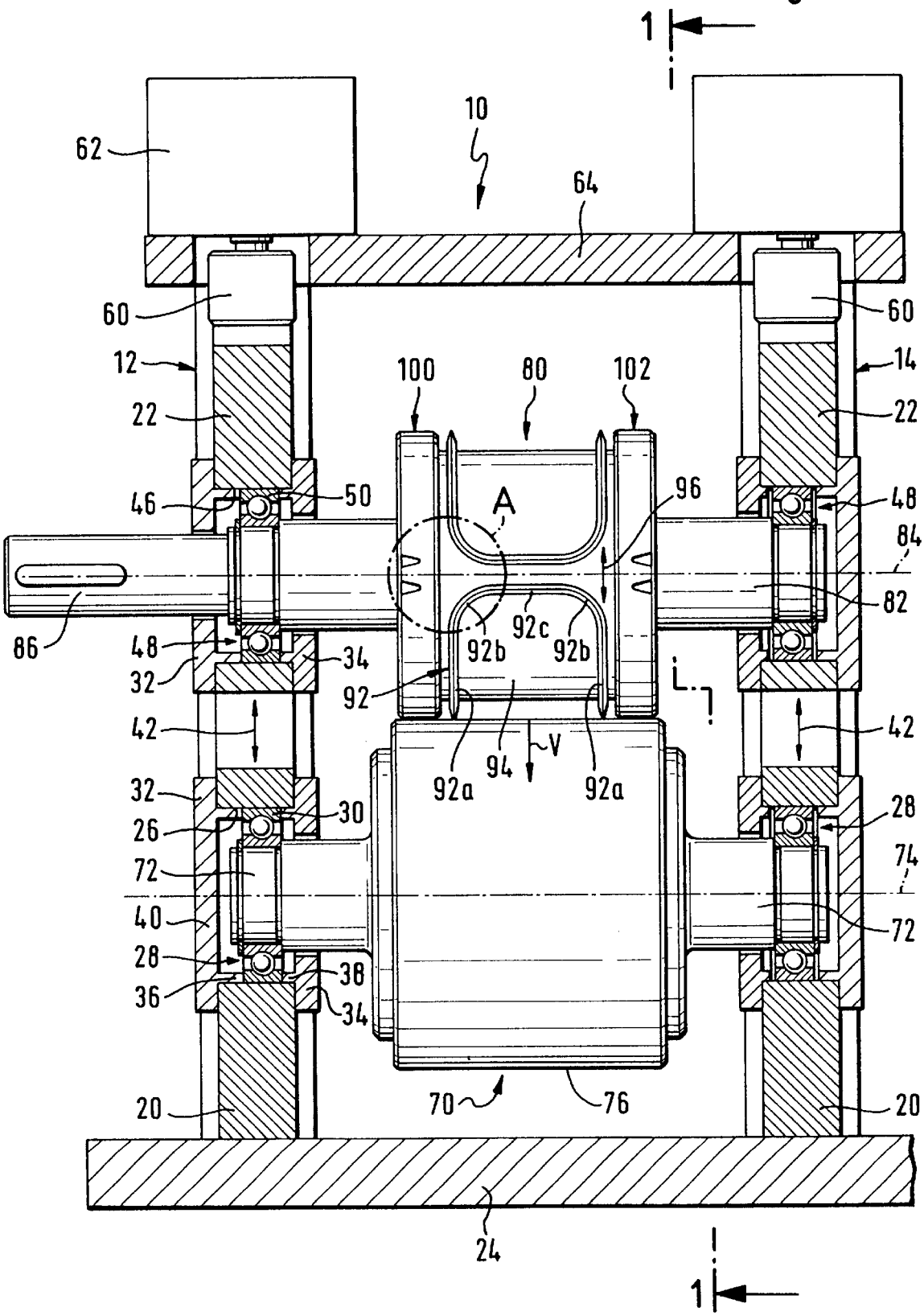
FIG. 2 a vertical section taken along line 2—2 in FIG. 1.

An inventive cutting device shown in section in FIGS. 1 and 2 comprises a machine frame generally designated 10 having two bearing parts 12 and 14 arranged in spaced relation to each other.

Each of the bearing parts, for example, the bearing part 12 in FIG. 1, comprises two side carriers 16 and 18, between which a lower bearing carrier 20 and an upper bearing carrier 22 are arranged.

The lower bearing carrier 20 is, on the one hand, guided between the side carriers 16 and 18, and, on the other hand, firmly seated on a base plate 24 of the machine frame 10. The bearing carrier 20 has a bearing receiving means 26 in which a lower pivot bearing generally designated 28 is inserted with its outer bearing ring 30, and the outer bearing ring 30 rests with its outer circumferential side against an inside surface of the bearing receiving means 26.

The bearing ring 30 is fixed in the bearing receiving means 26 by an outer holding body 32 and an inner holding body 34, which rest with holding rings 36 and 38 against side ring surfaces of the outer bearing ring 30 and thereby fix the latter in the bearing receiving means 26. At the same time, the outer holding body 32 comprises a cover 40.

The upper bearing carrier 22 is guided between the side carriers 16 and 18 and is arranged for adjustment in a direction 42 running parallel to the course of the side carriers 16 and 18, in the direction of the lower bearing carrier 20. The upper bearing carrier 22 also has a bearing receiving means 46 in which an upper pivot bearing 48 is inserted.

The upper pivot bearing 48 is held with its outer bearing ring 50 in a contacting manner in the bearing receiving means 46 in the same way as the lower pivot bearing 28 with the outer bearing ring 30. Also provided are an outer holding body 32 and an inner holding body 34 which are constructed in the same way as the holding bodies provided in the lower bearing carrier 20 and fix the outer bearing ring 50 of the upper pivot bearing 48 in the same way.

The upper bearing carrier 22 is, in turn, supported via a pretensioning device generally designated 60 on an abutment 62 which is held on an upper plate 64 extending parallel to the base plate 24. The upper plate 64 likewise joins the bearing parts 12 and 14 to each other and also fixes the side carriers 16 and 18 relative to each other.

The bearing part 14 is constructed in the same way as the bearing part 12.

A shaft stub 72 is mounted in each of the two lower pivot bearings 28. The shaft stubs 72 protrude at the sides from an anvil drum generally designated 70 and are arranged concentrically with an axis of rotation 74 of the anvil drum 70. The anvil drum 70 has a larger radius than the shaft stub 72 and is provided with a circular-cylindrical anvil surface 76 arranged coaxially with the axis of rotation 74.

The anvil drum 70 is thus firmly mounted by the two lower pivot bearings 28 in the lower bearing carriers 20, which, in turn, rest on the base plate 24 and are guided between the side carriers 16 and 18.

A tool shaft 82 is mounted in the upper pivot bearings 48 of the upper bearing carriers 22 for rotation about an axis of rotation 84. The tool shaft 82 extends, for example, through the bearing part 12 and has on its side opposite the rotating tool 80 a drive stub 86 which protrudes beyond the bearing part 12 and via which the rotating tool 80 is rotatingly driven by a drive, for example, a motor.

The rotating tool 80 is movable by the arrangement of the upper pivot bearings 48 in the upper bearing carriers 22 and their displaceability in direction 42 in the direction of the anvil drum 70. By means of the pretensioning devices 60 which act on the upper bearing carriers 22, the rotating tool 80 is pretensionable in the direction of the anvil drum 70 such that the tool 80 acts as a whole with a pretensioning force V on the anvil drum 70.

To sever a web of material generally designated 90 and guided between the rotating cutting tool 80 and the anvil drum 70, the rotating cutting tool 80 comprises cutters 92 which protrude from a cutter base surface which is, for example, cylindrical in relation to the axis of rotation 84, in a radial direction relative to the axis of rotation 84, with a constant radial extent with respect to the axis of rotation. For example, the cutter 92 comprises two cutter legs 92*a* extending in azimuthal direction in relation to the axis of rotation 84. The cutter legs 92*a* continue into cutter arcs 92*b* which extend transversely to the cutter legs 92*a* and are then joined by a transverse cutter 92*c* extending approximately vertically to the azimuthal direction 96 and hence approximately parallel to the axis of rotation 84 (FIG. 3).

Figure 3:
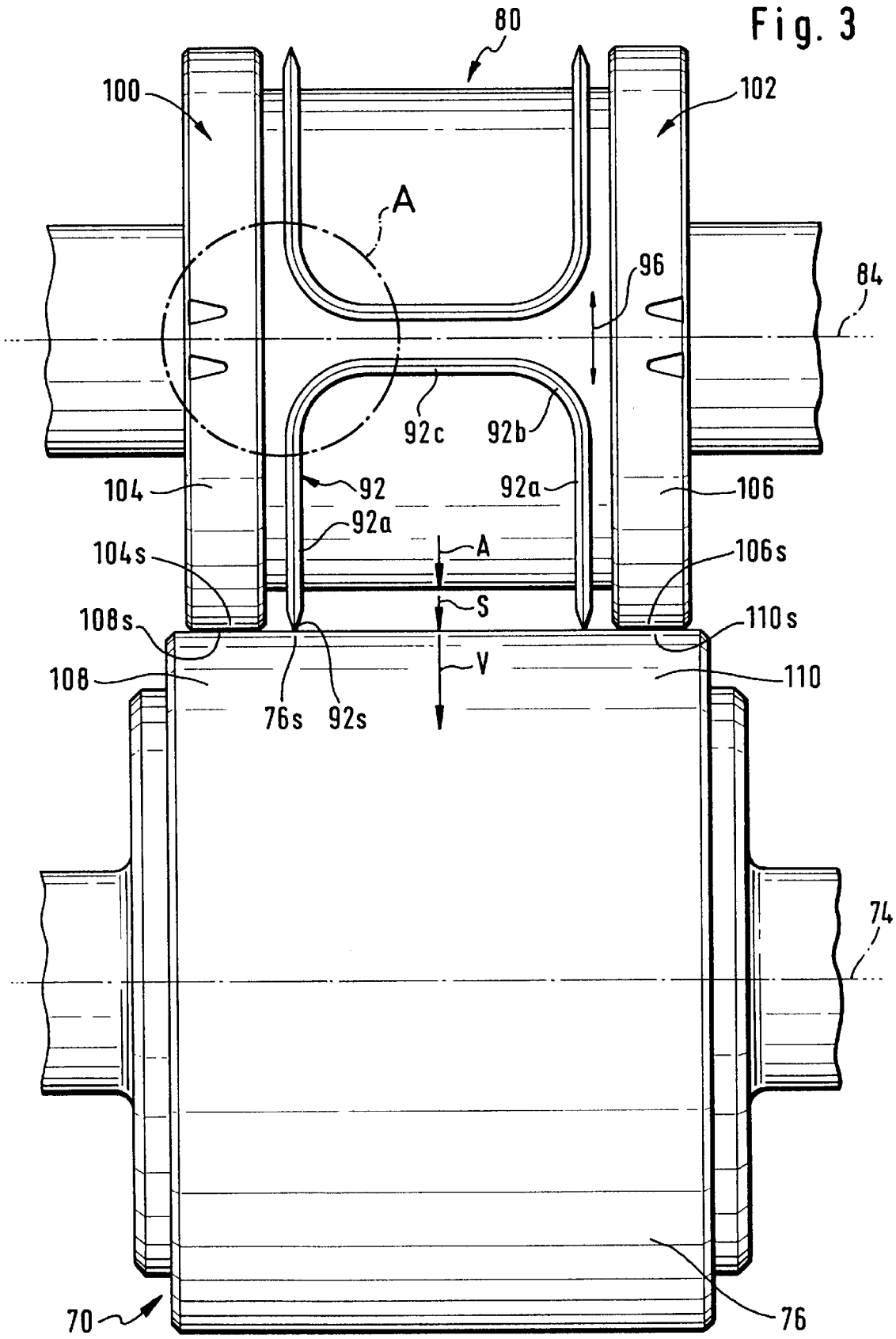
FIG. 3 an exploded illustration of anvil drum and cutting tool according to FIG. 2.
Figure 4:
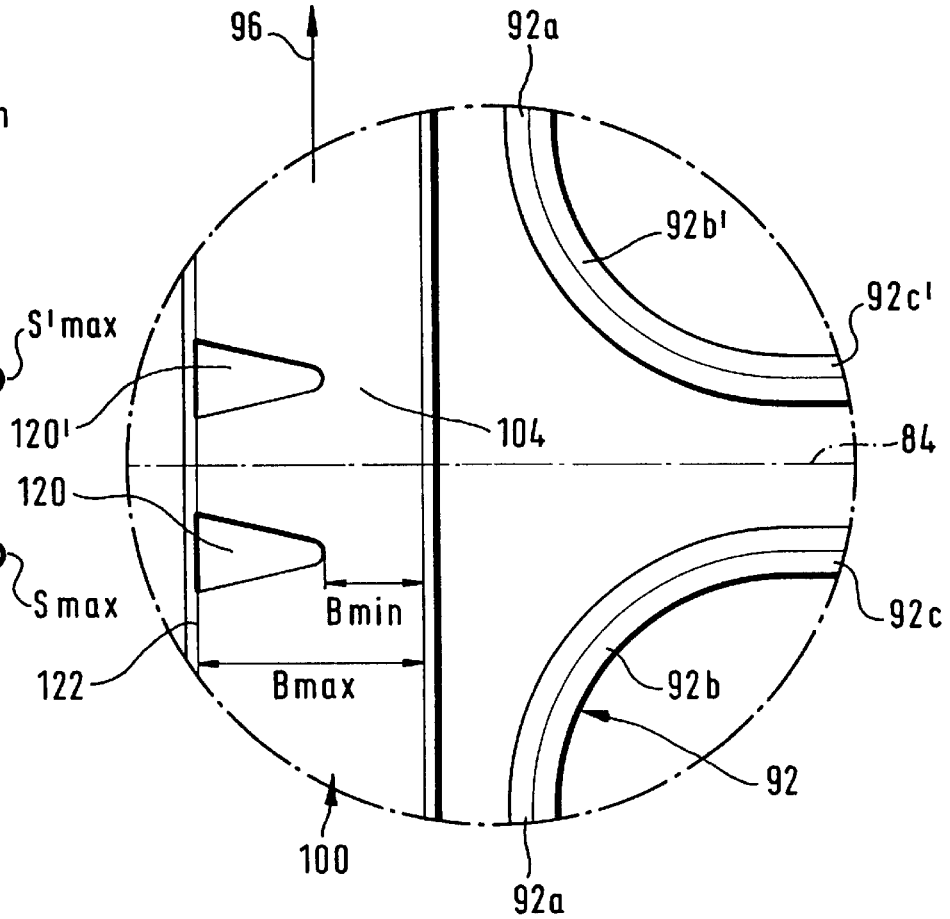
FIG. 4 an exploded illustration of areas A in FIGS. 2 and 3.

For example, the cutter 92 comprises two transverse cutters 92*c* and 92*c*', starting from which the cutter arcs 92*b* and 92*b*' extend in opposite directions and then continue into the cutter legs 92*a* which join together the cutter arcs 92*b* and 92*b*' located on either side of the transverse cutters 92*c* and 92*c*', as shown in an exploded view in FIG. 3 and in a further exploded view of a detail in FIG. 4.

The cutting action of the cutter 92 occurs, as shown in FIG. 3, by cooperation of an operative cutter section 92*s* which faces a corresponding anvil surface section 76*s* at a minimal distance therefrom or almost touches the latter. By the rotation of the rotating cutting tool 80 and co-rotation of the anvil drum 70, respectively successive cutter sections 92*s* and anvil surface sections 76*s* stand in their operative position and cooperate in a cutting manner.

To fix in a defined manner a slight spacing between the respectively cooperating cutter sections 92*s* and anvil surface sections 76*s* or a so-called slight contacting thereof, the rotating cutting tool 80 has two supporting rings 100 and 102 rotationally fixedly connected thereto, which, for example, are arranged on both sides of the cutter 92 coaxially with the axis of rotation 84 and have supporting ring surfaces 104 and 106, respectively, which, for example, are arranged cylindrically in relation to the axis of rotation 84 and rest on supporting surfaces 108 and 110 of the anvil drum 70. The supporting surfaces 108 and 110 may, for example, be formed by partial areas of the anvil 76.

The supporting is effected via the supporting ring sections 104*s* and 106*s*, which are seated on corresponding supporting surface sections 108*s* and 110*s* of the supporting surfaces 108 and 110, and upon rotation of the rotating tool 80, supporting ring sections 104*s* and 106*s* arranged successively in the direction opposite to the direction of rotation of the rotating tool 80 cooperate with supporting surface sections 108*s* and 110*s* arranged successively in the direction opposite to the direction of rotation of the anvil drum 70.

The supporting ring sections 104*s*, 106*s* and supporting surface sections 108*s* and 110*s* cooperating with one another together absorb a bearing force A with which the rotating cutting tool 80 is supported on the anvil drum 70 and which constitutes a part of the pretensioning force V included therein.

However, the pretensioning force V results not only in formation of the bearing force A acting via the supporting rings 100 and 102 on the anvil drum 70, but also in a cutting force S which is related to a cutter length operative in the respective cutter section 92*s*.

If, for example, one assumes that the respective cutter section 92*s* and the corresponding anvil surface section 76*s* which cooperate with each other, have in the azimuthal direction 96 an essentially infinitesimally short extent, in the ideal case a dot-shaped extent, then the cutting force S required for cutting the material 90 in the area of the cutter legs 92*a* is slight, as the cutter legs 92*a* are likewise only operative with their infinitesimally short or even dot-shaped cutter length in the azimuthal direction 96 in the operative cutter section 92*s*. Contrary to this, the operative cutter length is large when the transverse cutter 92*c* extending essentially vertically to the azimuthal direction 96 forms the operative cutter section 92*s* which cooperates with the corresponding anvil surface section 76*s*, as the operative cutter length corresponds to the extent of the transverse cutter 92*c* vertically to the azimuthal direction 96. At this point, the greatest cutting force is required for severing the material 90.

Figure 5:
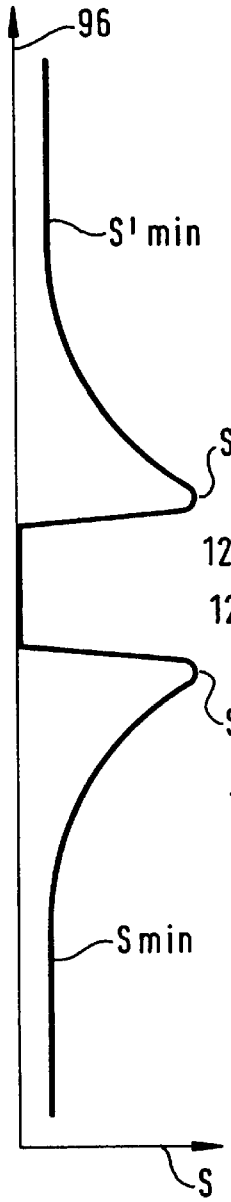
FIG. 5 a schematic illustration of a course of the cutting force over the azimuthal direction in correlation with a course of the cutters of the cutting tool in FIG. 4.

A course of the cutting force S occurring with such a geometry of the cutter 92 in relation to the course of the cutter 92 is, therefore, shown in FIG. 5. In accordance with FIG. 5, the maximum cutting force Smax in relation to the azimuthal direction 96 occurs when the transverse cutters 92*c* and 92*c*' form the operative cutter sections 92*s*.

In contrast thereto, the cutting force S starting from the maximum value Smax decreases when the cutter arcs 92*b* form the operative cutter sections, and with progressive passage through the cutter arcs 92*b* away from the transverse cutters 92*c*, the effective cutter length and hence the cutting force S decreases to a minimum value Smin of the cutting force, which occurs when the cutter legs 92*a* form the operative cutter sections 92*s*.

As the sum of cutting force S and bearing force A equals the pretensioning force V, and the pretensioning force V is constant, it follows from the cutting force S and the variation thereof between the minimum cutting force Smin and the maximum cutting force Smax shown in FIG. 5 that the bearing force A has an exactly reverse course, i.e., when the cutting force has reached its maximum value Smax, the bearing force is minimal and vice-versa.

As each material, in particular, also steel, has an elasticity with the forces occurring with an inventive cutting device, the construction of the supporting rings 100 and 102 as rings constructed invariantly in the azimuthal direction 96 would result in these experiencing their maximum deformation in the case of a large bearing force A, and in the case of the minimum bearing force A, which coincides with the maximum cutting force Smax, a minimum deformation, so that the distance of the operative cutter section 92*s* from the respectively operative anvil surface section 76*s* would thus vary, and, in particular, when the transverse cutter 92*c* forms the operative cutter section 92*s* the distance of the transverse cutter 92*c* from the operative anvil surface section 72*s* would be maximum so that in the case of materials 90 which are sensitive to cutting, for example, materials with very fine fibers in the range of less than 100 $\mu$, the transverse cutters 92*c* would produce no cutting action whatever or only unsatisfactory cutting action. On the other hand, if the pretensioning force were set so that the transverse cutters still produced a satisfactory cutting action, the distance of the cutter legs 92*a* forming an operative cutter section 92*s* from the corresponding operative anvil surface section 76*s* would be too small and so the cutter legs 92*a* would become blunt in the course of the cutting.

For this reason, provision is made in accordance with the invention for the elastic behavior of the supporting rings 100, 102 to vary in the azimuthal direction 96.

In the embodiment shown in FIGS. 1 to 4, the supporting rings 100 and 102 are provided with cut-outs 120, 120', which extend, for example, from an outer edge 122 of the supporting rings 104, 106 in the direction approximately parallel to the axis of rotation 84 into the respective supporting ring 100, 102 and hence reduce a width B of the supporting ring 100, 102 from a width Bmax to a width Bmin. Such a supporting ring 100, 102 reduced with respect to its width transversely to the azimuthal direction 96 undergoes deformation at the location of reduced width given a constant bearing force A to a greater extent and so the expanse of the cut-out 120 can be chosen such that the deformation of the supporting ring 100, 102 with the width Bmin and with maximum cutting force Smax and hence minimum bearing force A in the radial direction in relation to the axis of rotation 84 is approximately equal to the deformation in the radial direction which occurs with minimum cutting force Smin and hence maximum bearing force A and maximum width Bmax of the supporting ring 104. It is thus ensured that the distance of the transverse cutter 92*c*, when this represents an operative cutter section 92*s*, from the anvil surface section 76*s* is approximately equal in size to the distance of a cutter leg 92*a*, when the latter represents an operative cutter section 92*s*, from the corresponding operative anvil surface section 76*s*. Starting from the maximum width Bmax of the supporting ring, the shape of the cut-out 120 can be selected such that the transition from the maximum width Bmax to the minimum width Bmin either corresponds essentially to the increase of the cutting force from Smin to Smax and hence to the decrease in the bearing force from the maximum value to the minimum value. Or, it is also possible to select the cut-out 120 such that in any case the minimum width Bmin in the azimuthal direction 96 coincides with the position of the transverse cutter 92*c* without an adaptation to the increase of the cutting force S from Smin to Smax in the course of the cutter arc 92*c* being taken into account exactly.

Figure 6:
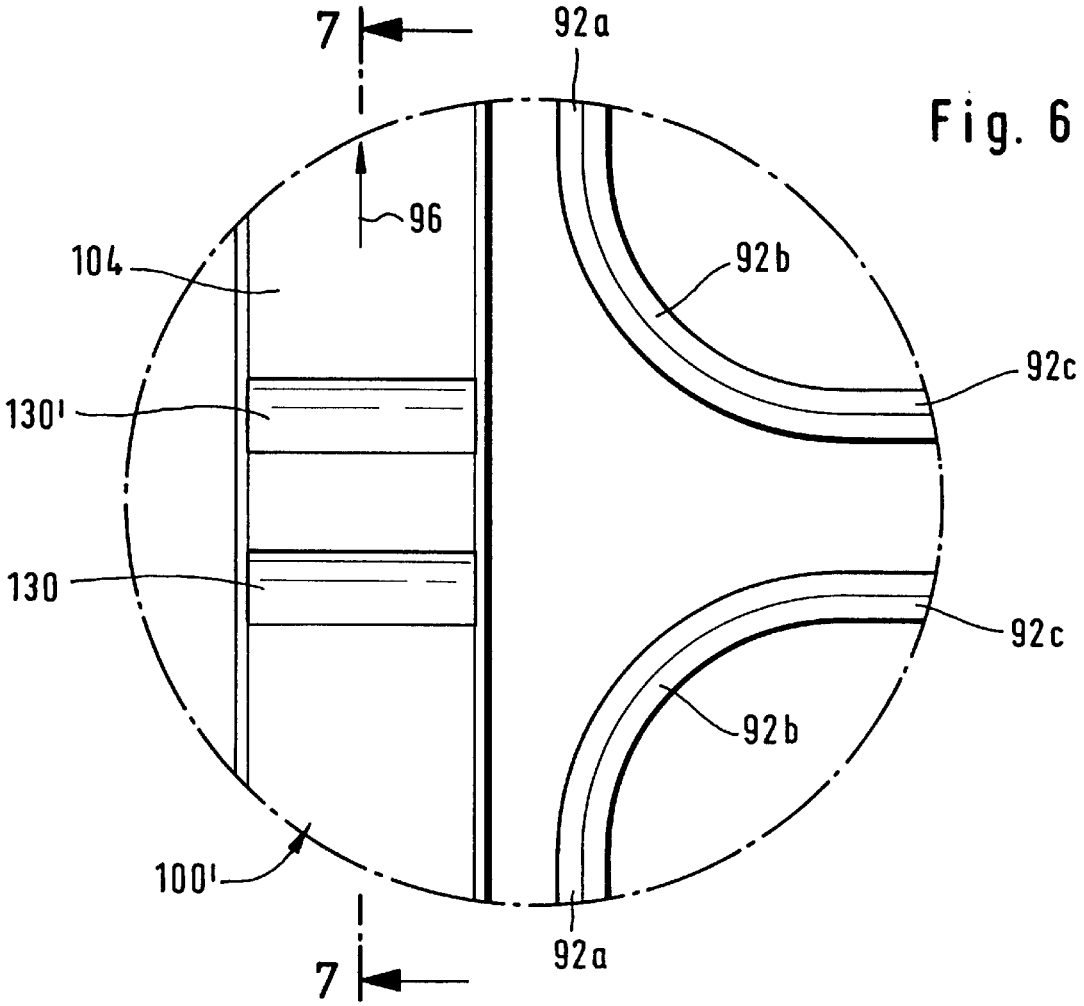
FIG. 6 an exploded illustration similar to FIG. 4 of a second embodiment.
Figure 7:
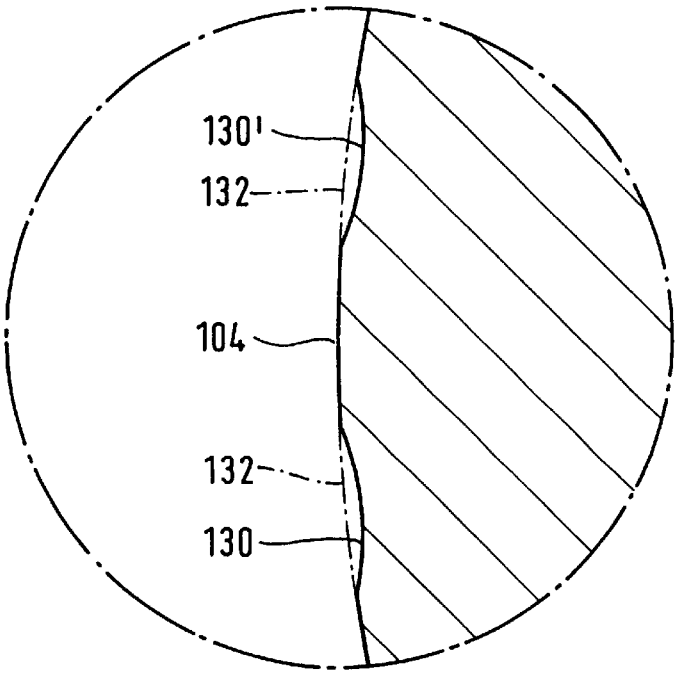
FIG. 7 a further exploded illustration of the section taken along line 7—7 in FIG. 6.
Figures 8, 9:
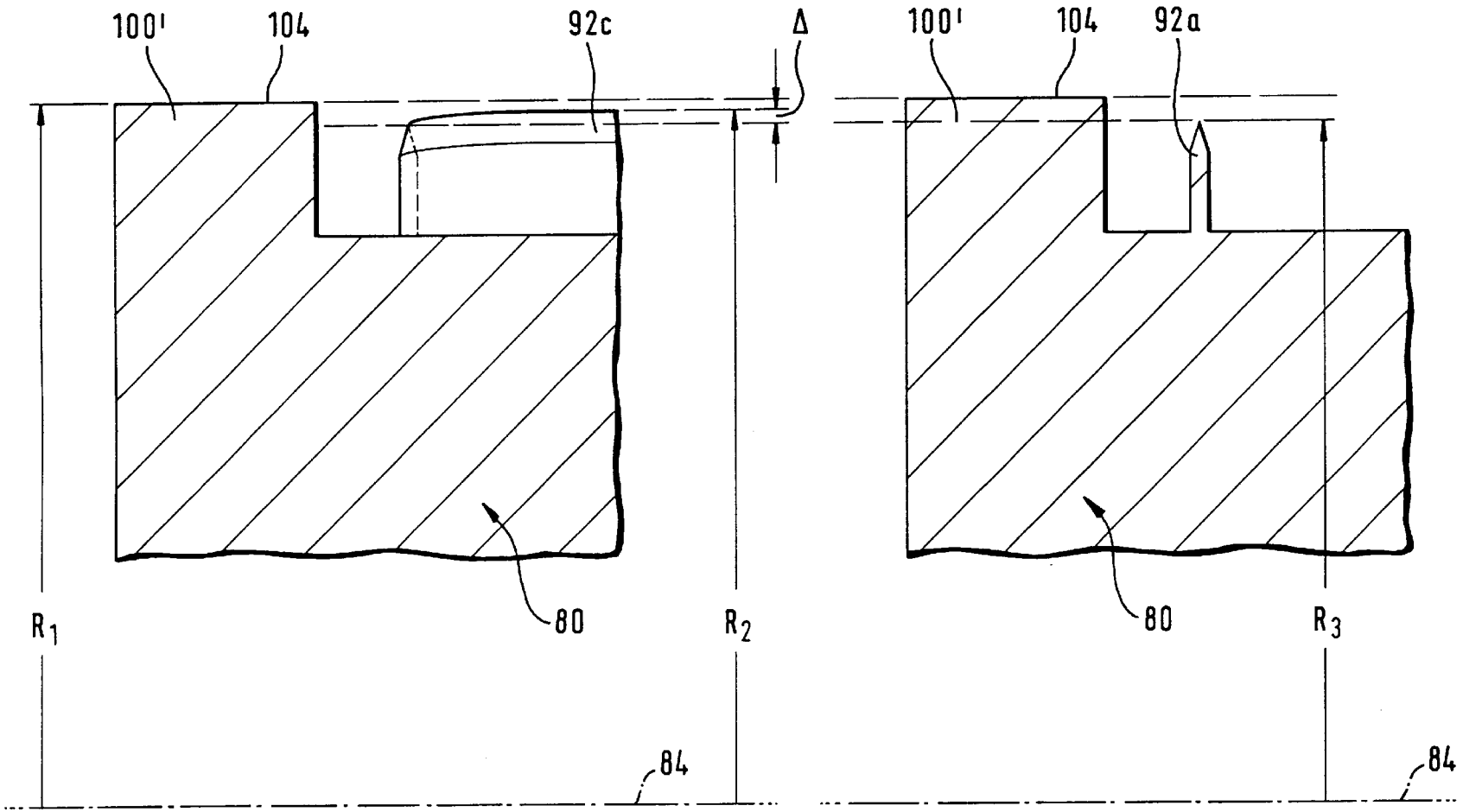
FIG. 8 an exploded, detailed illustration of a radial section in the area of a transverse cutter.
FIG. 9 an exploded, detailed illustration of a radial section similar to FIG. 8 in the area of a cutter leg.

In a second embodiment of an inventive solution, shown in FIGS. 6 and 7, there is primarily no adaptation of the elasticity of the respective supporting ring 100', but rather the respective supporting ring 100' is provided, when seen in the azimuthal direction 96, in areas in which the maximum cutting force Smax occurs, with a flattening or recess 130, 130' whose deviation from a cylindrical circumferential line 132 corresponds essentially to the change in the radial extent of the supporting ring surface 104 which occurs when the bearing force passes from its maximum value with minimum cutting force Smin to the minimum value with maximum cutting force Smax.

Due to the course of the flattenings or recesses 130, 130' deviating from the cylindrical surface 132, it is thus also possible to essentially reproduce the course of the decrease and increase of the bearing force A or to at least approximately ensure that when the transverse cutter 92*c* forms the operative cutter section 92*s*, its spacing from the operative anvil surface area 76*s* is of approximately the same size as the spacing of a cutter leg 92*a* from the corresponding anvil surface section 76*s* when this cutter leg 92*a* forms the operative cutter section 92*s*.

In the second embodiment, owing to the slight radial extent of the recess 130, 130' it is essentially not a question of a changed elasticity of the respective supporting ring 100', but rather of a direct compensation of the radial extent of the corresponding supporting ring 100 which is reduced on account of the variation of the bearing force A occurring due to the recess 130, 130'.

In the second embodiment, it is, however, also conceivable to form the recesses 130, 130' as pockets which do not extend over the entire width of the respective supporting ring 100 so that there remains at the sides thereof an area of the supporting ring 100 which extends as far as the cylindrical surface 132 and which then becomes operative on account of its altered elasticity.

In a third embodiment, the supporting rings 100' can be constructed with an essentially ideal cylindrical shape 132 with a radial extent $R_1$ to the axis of rotation 84, and instead of the recess 130, 130' a corresponding "elevation" Δ of the radial extent $R_2$ of the transverse cutters 92*c* to the axis of rotation 84 relative to the radial extent $R_3$ of the cutter legs 92*a* is to be provided so that the larger radial extent of the supporting rings 100' in the case of minimum bearing force is tolerated, but this does not impair the cutting action of the transverse cutters 92*c* as these have a radial extent with respect to the axis of rotation 84 which is correspondingly greater by the amount Δ than that of the cutter legs 92*a*, as the supporting rings undergo in the region of the latter, on account of the maximum bearing force A and the minimum cutting force Smin, a greater deformation in the radial direction.

What is claimed is:

1. A cutting device comprising:

a machine frame;

an anvil drum mounted on said machine frame for rotation about an axis of rotation and having an anvil surface;

a cutting tool mounted on said machine frame for rotation about an axis of rotation and having a cutter cooperating with said anvil surface such that in successive rotary positions, respectively successive cutter sections stand in an operative position with successive anvil surface sections in order to cut a material passing between said cutting tool and said anvil drum;

said cutter being constructed such that different cutting forces occur when different cutter sections cooperate with corresponding anvil surface sections;

said cutting tool and said anvil drum being pretensioned in a direction towards each other with a pretensioning force;

said cutting tool being supported by means of at least one supporting ring arranged non-rotatably relative to said cutting tool via successive supporting ring sections on successive supporting surface sections arranged non-rotatably relative to said anvil drum;

wherein:

the respectively operative supporting ring section acts on the respectively operative supporting surface section with a bearing force corresponding approximately to the difference between the pretensioning force and the cutting force; and successive supporting ring sections vary in at least one of elasticity and shape to apply a variable bearing force to operative cutter sections corresponding to said supporting ring sections, such that with the variable bearing force respectively resulting from approximately the difference between the pretensioning force and the cutting force, said supporting ring holds said cutter section standing in the operative position at a defined spacing from the corresponding operative anvil surface section.

2. A cutting device in accordance with claim 1, wherein said successive supporting ring sections have an elasticity which varies due to a variation of shape.

3. A cutting device in accordance with claim 2, wherein said supporting ring sections are constructed so as to vary with respect to their cross-sectional areas extending perpendicularly to the azimuthal direction.

4. A cutting device in accordance with claim 3, wherein in order to produce the variation of said cross-sectional areas, said supporting ring is formed from a ring having a constant cross-sectional area into which recesses are provided.

5. A cutting device in accordance with claim 1, wherein successive supporting ring sections have a radial extent which varies with respect to the axis of rotation.

6. A cutting device in accordance with claim 5, wherein said varying radial extent is brought about by a recess extending in the radial direction.

7. A cutting device in accordance with claim 1, wherein a cutter section requiring a high cutting force in its operative position has a greater radial extent with respect to the axis of rotation than a cutter section requiring a lower cutting force.

8. A cutting device in accordance with claim 1, wherein said supporting ring is seated on said cutting tool.

9. A cutting device in accordance with claim 8, wherein said supporting ring is shrunk onto said cutting tool.

10. A cutting device in accordance with claim 8, wherein said supporting ring is integrally joined to said cutting tool.

11. A cutting device in accordance with claim 1, wherein supporting rings are provided on both sides of said cutting tool.

12. A cutting device in accordance with claim 1, wherein said supporting surfaces are arranged on said anvil drum.

13. A cutting device in accordance with claim 12, wherein said supporting surfaces form a partial area of said anvil surface.

* * * * *